US009462867B2

(12) United States Patent
Li

(10) Patent No.: US 9,462,867 B2
(45) Date of Patent: Oct. 11, 2016

(54) AUTOMATIC WASHING AND SHAMPOOING HAIR MACHINE

(71) Applicant: Siping Li, Fuan (CN)

(72) Inventor: Siping Li, Fuan (CN)

( * ) Notice: Subject to any disclaimer, the term of this patent is extended or adjusted under 35 U.S.C. 154(b) by 193 days.

(21) Appl. No.: 14/524,083

(22) Filed: Oct. 27, 2014

(65) Prior Publication Data

US 2015/0335125 A1 Nov. 26, 2015

(30) Foreign Application Priority Data

May 21, 2014 (CN) ..... 2014 1 0214838

(51) Int. Cl.

| | |
|---|---|
| ***A45D 19/02*** | (2006.01) |
| ***A45D 19/14*** | (2006.01) |
| ***A45D 19/16*** | (2006.01) |
| ***A61H 35/00*** | (2006.01) |
| ***A61H 39/04*** | (2006.01) |
| *A45D 19/00* | (2006.01) |
| *A61H 15/00* | (2006.01) |

(52) U.S. Cl.

CPC ..... *A45D 19/14* (2013.01); *A45D 19/16* (2013.01); *A61H 15/00* (2013.01); *A61H 35/008* (2013.01); *A61H 39/04* (2013.01); *A45D 2019/005* (2013.01); *A45D 2019/0058* (2013.01); *A45D 2200/207* (2013.01); *A61H 2015/0007* (2013.01); *A61H 2201/0103* (2013.01); *A61H 2201/0111* (2013.01); *A61H 2201/165* (2013.01); *A61H 2201/5002* (2013.01); *A61H 2201/5097* (2013.01)

(58) Field of Classification Search

CPC ..... A45D 19/08; A45D 19/14; A45D 19/18
USPC ..... 4/518
See application file for complete search history.

(56) References Cited

U.S. PATENT DOCUMENTS

| | | | | | |
|---|---|---|---|---|---|
| 2,856,918 | A | * | 10/1958 | Kingery | A45D 19/14 132/202 |
| 2,914,066 | A | * | 11/1959 | Gow | A45D 19/14 4/517 |
| 3,177,868 | A | * | 4/1965 | Wallace | A45D 19/14 132/202 |
| 3,416,517 | A | * | 12/1968 | Harry | A45D 19/14 132/207 |
| 4,078,557 | A | * | 3/1978 | Spencer | A61H 7/006 132/212 |
| 5,235,709 | A | * | 8/1993 | Terlep | A45D 19/14 4/515 |

* cited by examiner

*Primary Examiner* — Huyen Le
(74) *Attorney, Agent, or Firm* — Rankin, Hill & Clark LLP

(57) ABSTRACT

The present invention discloses an automatic hair washing machine comprising a housing body formed with a top housing and a rear housing by integrally molding, the housing body is shaped like a head, and an annular extensible waterproof rim is provided along the edge of the housing body, a water spray hood is arranged in the housing body, the water spray hood is connected to the water inlet pipe, and there is also a shampoo reservoir in or out of the housing body, and a plurality of rotatably driven hollow massaging and rubbing fingers are arranged along the interior of the housing body. The automatic hair washing machine disclosed in the present invention can relieve nervous emotion for a user by spraying and massaging the user's hair to shampoo his hair by means of the water spay hood without lying supine or bending over the user during the whole hair washing process, and can ensure adequate comfort for him by massaging his acupuncture points such as his temple by means of the hollow massaging and rubbing fingers.

9 Claims, 1 Drawing Sheet

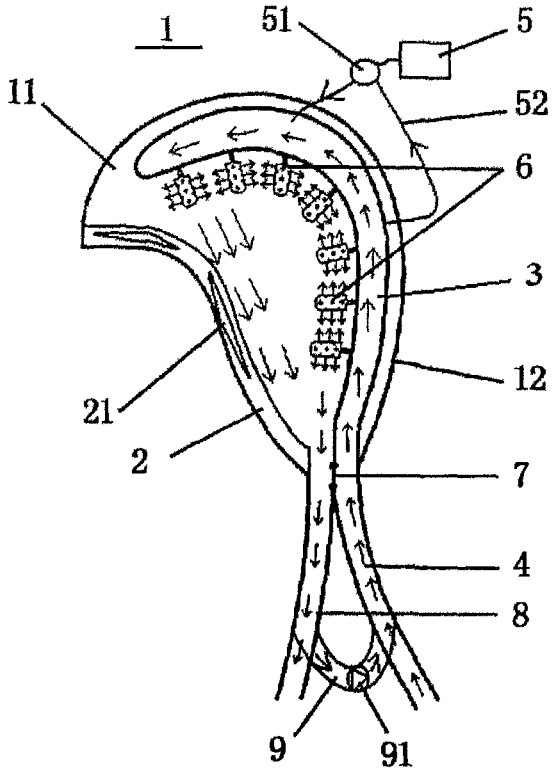
1
51
5
11
52
6
3
12
21
2
7
4
8
9
91

AUTOMATIC WASHING AND SHAMPOOING HAIR MACHINE

TECHNICAL FIELD

The present invention relates to the field of hair washing tools, in particular, an automatic hair washing machine.

BACKGROUND

Although the prior art of washing hair is called an automatic hair washing machine, it still applies the traditional ways of lying supine or bending over a person to wash his hair, and the person has to go to a fixed consumption location such as the barber's shop to wash his hair. The disadvantages of the existent shampoo devices are:

(1) large volume;

(2) only applied in predefined areas;

(3) limiting the free movable space of the washed person;

(4) wasting the time of shampooing and the time on road;

(5) low efficiency;

(6) costly;

(7) failing to meet the requirements of special groups of people.

SUMMARY OF THE INVENTION

In order to solve the above problems, the present invention provides an automatic hair washing machine, for washing a user without lying supine him to facilitate the aged, the disabled such as the people seated on a wheel chair, the people that could not bend over, and the special groups of people, for massaging his head and relieving his nervous emotion, for facilitating free walking in a certain range, and for simultaneously working, brush his teeth, washing clothes, reading books, and surging in internet during automatic hair washing.

The principle and conception of the invention is implemented by the following technical solutions:

The automatic hair washing machine comprises a housing body formed with a top housing and a rear housing by integrally molding, the housing body is shaped like a head, and an annular extensible waterproof rim is provided along the edge of the housing body, a water spray hood is arranged in the housing body, the water spray hood is connected to the water inlet pipe, and there is also a shampoo reservoir in or out of the housing body, and a plurality of rotatably driven hollow massaging and rubbing fingers are arranged along the interior of the housing body, the hollow massaging and rubbing fingers are connected to the water spray hood; there is a water outlet port at the bottom of the rear housing, and a bidirectional valve is arranged at the water outlet port, the bidirectional valve is connected to the water inlet pipe at a lower portion of the water spray hood.

The outlet of the shampoo reservoir is connected to an atomizer, and the atomizer is simultaneously connected to the water inlet pipe by a slender tube, on which a control valve is provided.

Further, the automatic hair washing machine in the present invention comprises a hair conditioner reservoir to store a hair conditioner, the outlet of the hair conditioner reservoir is connected to the atomizer.

The outlet of the atomizer is connected to a rear portion of the water spray hood to spray out an atomized mixture liquid of shampoo and water through the water spray hood so as to facilitate foam and spread.

The water outlet port is connected to a water outlet pipe, meanwhile the water outlet port is connected to a water circulating pipe, the water circulating pipe is connected to the water inlet pipe, and a circulating pump is arranged on the water circulating pipe to achieve washing and massaging the user's head repeatedly.

The extensible waterproof rim is made of an elastic material so as to fit the user's head tightly.

The extensible waterproof rim is connected to the housing body in seal, and a plurality of air inflated bags are arranged in the interior of the extensible waterproof rim, each corresponds to a particular position of the head; preferably, it is arranged on the extensible waterproof rim corresponding to the rear portions of two ears, the center of the rear neck, the tip of the brow or the corner of the eye.

The plurality of air inflated bags are inflated by an air pump so as to ensure that the housing body fits the head tightly and prevents leaking out the water when it is in an operation status.

The hollow massaging and rubbing fingers are divided into two groups, the two groups of the hollow massaging and rubbing fingers operate alternatively; when one group operates, the other group's function is fixing.

Further, the automatic hair washing machine of the present invention also comprises a controller connected to control valves respectively to achieve different operation modes by controlling a corresponding control valve respectively. Meanwhile the controller is also connected to each hollow massaging and rubbing finger to achieve the purpose of controlling a corresponding hollow massaging and rubbing finger. Preferably, it is achieved by a wireless remote control, that is, by adding a remote controller.

The beneficial effects of the technical solution of the embodiment of the present invention are as follows:

The automatic hair washing machine disclosed in the present invention can relieve nervous emotion for a user by spraying and massaging the user's hair to shampoo his hair by means of the water spay hood without lying supine or bending over the user during the whole hair washing process, and can ensure adequate comfort for him by massaging his acupuncture points such as his temple by means of the hollow massaging and rubbing fingers. The atomizer facilitates to wash the user's head cleanly by atomizing the mixture liquid of shampoo and water. And the design of the circulating pump can save the water by using water repeatedly during the hair washing process, make a better hair washing effect, and improve the dandruff clean effect.

DESCRIPTION OF THE DRAWINGS

In order to illustrate the technical solution of the embodiments of the present invention or the prior art clearly, With reference to the accompanying drawings, the description of the embodiments of the present invention or the prior art are briefly described as follows. Obviously, the accompanying drawings described as follows are only embodiments of the present invention. Therefore, those skilled in the art could derive other drawings in accordance with the accompanying drawings described as follows without devoting creative work.

FIG. 1 illustrates a structure diagram of an embodiment of the automatic hair washing machine of the present invention.

DETAILED DESCRIPTION OF THE EMBODIMENTS

With reference to the accompanying drawings in the embodiments of the present invention, the technical solution of the embodiments of the present invention is described clearly and completely as follows. Apparently, the embodiments described as follows are only a part of the embodiments of the present invention, but not entire embodiments. Based on the embodiments of the present invention, all of the other embodiments which are derived without devoting a creative work by those skilled in the art should be deemed to fall within the protection scope of the present invention.

Embodiments

As shown in FIG. 1, the automatic hair washing machine in the present invention comprises a housing body 1 formed with a top housing 11 and a rear housing 12 by integrally molding. The housing body 1 is shaped like a head. During the producing process, the housing body 1 generally follows the shape of a head. In addition, the housing body 1 is ensured to be set behind the head, and to keep at least 1-2 centimeters gap between the inner shell of the housing body 1 and the head so as to facilitate cleaning.

Regarding to the automatic hair washing machine, it is produced as a helmet mode with a function of charging and a function of memorizing. The hair washing machine could be configured as one of three levels corresponding different size of the head so as to adapt the automatic hair washing machine to different dimensions of the head of different family member.

An annular extensible waterproof rim 2 is provided along the edge of the housing body 1. The extensible waterproof rim 2 is made of an elastic material so as to fit the user's head tightly. The extensible waterproof rim 2 has good flexibility and elasticity to make sure to closely contact with the portions such as the forehead, the cheeks, the ears and the neck during the process of using the extensible waterproof rim 2, so that the water will not leak and flow even if the water is poured into the housing body 1 after the extensible waterproof rim 2 is installed.

The extensible waterproof rim 2 is connected to the housing body 1 in seal, so that problems such as osmosis and leakage would not occur between the housing body 1 and the extensible waterproof rim 2.

A plurality of air inflated bags 21 are arranged in the interior of the extensible waterproof rim 2. Each of the air inflated bags 21 corresponds to a particular position of the head; preferably, it is arranged on the extensible waterproof rim corresponding to the rear portions of two ears, the center of the rear neck, the tip of the brow or the corner of the eye.

The plurality of air inflated bags 21 are inflated by an air pump so as to ensure that the housing body fits the head tightly and prevents leaking out the water when it is in an operation status.

Due to the differences in the size and the shape of each person's head, it is impossible for an ordinary extensible waterproof rim 2 to fit all the users' heads simultaneously. Therefore, the air inflated bag 21 is inflated, the fitness and tightness between the human head and the extensible waterproof rim 2 is improved after the air bag expands, the usage effect of the automatic hair washing machine is further kept, and adequate comfort and security of human body is ensured. Therefore, the basic requirements of all users could be met. This is a breakthrough in this field. So far there is no similar technology to apply the structure of the inflatable air inflated bag 21 to achieve the fitness degree between the human head and the housing body 1.

A water spray hood 3 is arranged in the housing body 1. The water spray hood 3 is connected to the water inlet pipe 4. And the water inlet pipe 4 is extended into the interior of the rear housing 12 of the housing body 1. The water inlet pipe 4 supplements and supplies water, and increases the hydraulic pressure, so that the water spray hood conduct water high-speed spray to achieve the purposes of efficiently cleaning on one hand, and of ensuring the adequate comfort of the head skin by hydraulic pressure massaging the head on other hand.

A shampoo reservoir 5 is arranged in the interior of the housing body 1, the shampoo reservoir 5 can also be placed at external of the housing body 1, as long as the shampoo in the shampoo reservoir 5 could be ensured to be sprayed on demand, and the effect of hair washing could be guaranteed.

A plurality of rotatably driven hollow massaging and rubbing fingers 6 are arranged along the interior of the housing body 1. The hollow massaging and rubbing fingers are connected to the water spray hood. Each hollow massaging and rubbing finger 6 for head can be rotated around its axis about 120 degrees of rotation angle. And they could achieve the massage effect for the head skin during the course of rotation. When needed, the hollow massaging and rubbing fingers 6 can be placed in extensive positions in the housing body 1 to massage the entire head skin. Then the automatic hair washing machine can also be used as a massager for head this moment.

Regarding to the hollow massaging and rubbing fingers, a plurality of rotatably driven hollow massaging and rubbing fingers, which could rotate in 360 degrees, are arranged in the automatic hair washing machine. The pressure spring on the top of each hollow massaging and rubbing finger is in a status of naturally extending when it does not operate so as to plays the function of supporting between the automatic hair washing machine and the head. Regarding to the function of massaging and the function of supporting, the hollow massaging and rubbing fingers are divided into two groups in the operation status; when the group A of the hollow massaging and rubbing fingers massage and rub, the group B stops massaging and rubbing and plays the function of supporting and fixing the automatic hair washing machine; when the group B massages and rubs, the group A stops massaging and rubbing and plays the function of supporting and fixing the automatic hair washing machine.

When the hollow massaging and rubbing fingers plays the function of massaging, it can work on a mode of hair washing massaging or work on a mode of hair conditioning massaging (the rotating speed and the pressure could be adjusted so as to generate different frequencies and forces for hair washing massaging or for hair conditioning massaging).

The top of each hollow massaging and rubbing finger is connected to the water inlet pipe, a shampoo pipe and a hair conditioner pipe. Each massaging and rubbing finger is hollow in the center. Three rings of water spray apertures are evenly distributed along the circumference of each massaging and rubbing finger. Wherein, one ring sprays water, another ring sprays shampoo, and still another ring sprays hair conditioner.

There is a water outlet port in the bottom of the rear housing 12. A conical water collecting portion is arranged on the top of the water outlet port to flow the liquid such as shampoo and water naturally.

A bidirectional valve 7 is arranged at the water outlet port. The bidirectional valve 7 is connected to the water inlet pipe at a lower portion of the water spray hood 3. The bidirectional valve 7 could play the function of switching the water outlet port and the function of switching the water inlet pipe simultaneously so as to save the switches configured on the water inlet pipe. Generally, at most one of the water outlet port and the water inlet pipe is guaranteed to be closed, and three states can be implemented:

The first state, water outlet port is on, water inlet pipe is off, and then it is time for the process of draining away water after hair is finished washing.

The second state, the water outlet port and the water inlet pipe are both on, and then it is time for the process of self-circulating by the circulating pump 91 so as to ensure the effect of hair washing;

The third state, the water outlet port is off, the water inlet pipe is on, and then it is time for the beginning of hair washing so as to wash and massage the head.

The outlet of the shampoo reservoir 5 is connected to an atomizer 51, and the atomizer 51 is simultaneously connected to the water inlet pipe 4 by a slender tube 52. A control valve (not shown in the drawings) is provided on the slender tube 52.

Similarly, a hair conditioner reservoir may be further included (not shown in the drawings). The outlet of the hair conditioner reservoir is connected with the atomizer 51, but at this time it is not connected with the slender tube 52 anymore. Therefore, a hair conditioner can be sprayed over the head after hair washing. But an ordinary hair washing machine is apparently unable to achieve spraying a hair conditioner over the head evenly. The atomizer 51 applied in the present invention can solve this technical problem perfectly, and unifies three devices of hair washing, hair conditioning, and massaging into one device, and thus it could gives users the optimal experience.

The outlet of the atomizer 51 is connected to a rear portion of the water spray hood 3 so as to spray an atomized mixture liquid of shampoo and water (or pure hair conditioner). Because the outlet of the atomizer 51 is small, the covering area cannot meet the requirements of usage. Therefore, the atomized mixture liquid of shampoo and water atomized by the atomizer 51 is sprayed through the water spray hood 3 so as to facilitate foaming and spreading and to ensure better effects of hair washing and hair conditioning.

There are two water spray hoods. Wherein, one is located in the center of the top housing 11, and the other in the center of the rear housing 12. And the two water spray hoods 3 are connected to the water inlet 4 respectively. Alternatively, the two water spray hoods 3 are connected in series and are afterwards connected to the water inlet 4. After combining using the two water spray hoods 3, the effect of hair washing is better because the top and the rear of the head can be washed cleanly separately. The preferred way is to connect the rear of the water spray hood 3 to an atomizer, a shampoo reservoir and a hair conditioner reservoir to ensure better effects of hair washing and hair conditioning.

The water outlet port is connected to a water outlet pipe 8; meanwhile the water outlet port is connected to a water circulating pipe 9. The water circulating pipe 9 is connected to the water inlet 4, and a circulating pump is arranged 91 on the water circulating pipe 9 to achieve washing and massaging the user's head repeatedly. The circulation pump can play a function of controlling the valve. When turning the circulating pump on, the circulating pump works. And at that time, one valve is necessary to be set both at the downstream of the conjunction portion of the water circulating pipe and the water outlet pipe; and another valve is necessary to be set on the lower portion of the conjunction portion of the water circulating pipe and the water inlet pipe 4. The two valves should be set respectively so as to avoid flowing out the water.

In the process of implementing, a corresponding valve can be set on the water inlet pipe, on the water circulating pipe and on the water outlet pipe to achieve different program controls.

The beneficial effects of the technical solution of the embodiment of the present invention are as follows:

The automatic hair washing machine disclosed in the present invention can relieve the nervous emotion for a user by spraying and massaging the user's hair to shampoo his hair by means of the water spay hood without lying supine or bending over the user during the whole hair washing process, and can ensure adequate comfort for him by massaging his acupuncture points such as his temple by means of the hollow massaging and rubbing fingers. The atomizer facilitates to wash the user's head cleanly by atomizing the mixture liquid of shampoo and water. And the design of the circulating pump can save the water by using water repeatedly during the hair washing process, make a better hair washing effect, and improve the dandruff clean effect.

The above described are only specific embodiments of the present invention, but the features of the present invention is not limited to the specific embodiments, and any change or modification that could be easily thought of by those skilled in the art should be deemed to fall within the protection scope of the present invention.

What is claimed is:

1. An automatic hair washing machine, characterized in that it comprises a housing body formed with a top housing and a rear housing by integrally molding, the housing body is shaped like a head, and an annular extensible waterproof rim is provided along a edge of the housing body, a water spray hood is arranged in the housing body, the water spray hood is connected to a water inlet pipe, and there is also a shampoo reservoir in or out of the housing body, and a plurality of rotatably driven hollow massaging and rubbing fingers are arranged along an interior of the housing body, the hollow massaging and rubbing fingers are connected to the water spray hood; there is a water outlet port at the bottom of the rear housing, and a bidirectional valve is arranged at the water outlet port, the bidirectional valve is connected to the water inlet pipe at a lower portion of the water spray hood.

2. The automatic hair washing machine as set forth in the claim 1, characterized in that an outlet of the shampoo reservoir is connected to an atomizer, and the atomizer is simultaneously connected to the water inlet pipe by a slender tube, on which a control valve is provided.

3. The automatic hair washing machine as set forth in claim 2, characterized in that it further comprises a hair conditioner reservoir to store a hair conditioner, an outlet of the hair conditioner reservoir is connected to the atomizer.

4. The automatic hair washing machine as set forth in the claim 2 or 3, characterized in that an outlet of the atomizer is connected to a rear portion of the water spray hood to spray out an atomized mixture liquid of shampoo and water through the water spray hood.

5. The automatic hair washing machine as set forth in any one of the claims 1, characterized in that the water outlet port is connected to a water outlet pipe; meanwhile the water outlet port is connected to a water circulating pipe, the water circulating pipe is connected to the water inlet pipe, and a circulating pump is arranged on the water circulating pipe to achieve washing and massaging the user's head repeatedly.

6. The automatic hair washing machine as set forth in the claim 1, characterized in that the extensible waterproof rim is made of an elastic material.

7. The automatic hair washing machine as set forth in the claim 6, characterized in that the extensible waterproof rim is connected to the housing body in seal, and a plurality of air inflated bags are arranged in an interior of the extensible waterproof rim, each corresponds to a particular position of the head; preferably, it is arranged on the extensible waterproof rim corresponding to the rear portions of two ears, the center of the rear neck, the tip of the brow or the corner of the eye.

8. The automatic hair washing machine as set forth in the claim 7, characterized in that the plurality of air inflated bags are inflated by an air pump so as to ensure that the housing body fits the head tightly and prevents leaking out the water when it is in an operation status.

9. The automatic hair washing machine as set forth in any one of the claims 1, characterized in that the hollow massaging and rubbing fingers are divided into two groups, the two groups of the hollow massaging and rubbing fingers operate alternatively; when one group operates, the other group's function is fixing.

* * * * *